US005718561A

United States Patent [19]

Fischer

[11] Patent Number: 5,718,561

[45] Date of Patent: Feb. 17, 1998

[54] SIDE CHANNEL COMPRESSOR

[75] Inventor: Peter Fischer, Bad Neustadt, Germany

[73] Assignee: Siemens Aktiengesellschaft, Germany

[21] Appl. No.: 533,969

[22] Filed: Sep. 26, 1995

[30] Foreign Application Priority Data

Nov. 22, 1994 [DE] Germany ..... 44 415 58.3

[51] Int. Cl.[6] ..... F04D 17/00

[52] U.S. Cl. ..... 415/182.1; 415/214.1

[58] Field of Search ..... 415/182.1, 214.1, 415/55.1

[56] References Cited

U.S. PATENT DOCUMENTS

| | | | |
|---|---|---|---|
| 945,742 | 1/1910 | Grunberg et al. | 415/55.1 |
| 1,619,286 | 3/1927 | Burks | 415/55.1 |
| 4,204,800 | 5/1980 | Bentele et al. . | |
| 5,205,707 | 4/1993 | Smith et al. | 415/214.1 |
| 5,443,364 | 8/1995 | Mistry et al. | 415/214.1 |

FOREIGN PATENT DOCUMENTS

| | | | |
|---|---|---|---|
| 143920 | 10/1951 | Australia | 415/214.1 |
| 1087060 | 2/1955 | France | 415/55.1 |
| A-18 17 430 | 12/1968 | Germany . | |
| A-21 25 042 | 5/1971 | Germany . | |
| B-27 21 233 | 5/1977 | Germany . | |
| A-42 39 814 | 11/1992 | Germany . | |
| A-43 41 266 | 12/1993 | Germany . | |

*Primary Examiner*—John T. Kwon
*Attorney, Agent, or Firm*—Kenyon & Kenyon

[57] ABSTRACT

The present invention relates to a side channel compressor with an impeller housing, on which are mounted at least two connecting units. Each of the connecting units have at least one inlet and at least one outlet orifice. It is possible to connect the necessary pipelines in different directions to the connecting units using this arrangement. Furthermore, the side channel compressor is adapted to use in both parallel and series connections, and includes features for both providing fluid connection between compressors and for sealing the inlet and/or outlet orifice when the compressors are connected.

6 Claims, 2 Drawing Sheets

SIDE CHANNEL COMPRESSOR

BACKGROUND OF THE INVENTION

1. Field of the Invention

The present invention relates to a side channel compressor including an impeller housing on which are mounted at least two connecting units. Each of the connecting units have at least one inlet and at least one outlet orifice.

2. Description of the Prior Art

A compressor is disclosed in German Patent No. C 43 41 266. In the compressor shown in that patent, each of the connecting units has one inlet orifice or one outlet orifice. Consequently, pipelines connected to the side channel compressor can only lead to the compressor housing from one direction. Thus, routing of pipelines is restricted when using the compressor, or the direction for connecting the pipelines must already be known or stipulated at the time of manufacturing or purchase of a compressor.

SUMMARY OF THE INVENTION

The object of the present invention is to provide a side channel compressor which makes it possible to connect the necessary pipelines in different directions. The object of the present invention is solved by providing each connecting unit with at least one inlet orifice and at least one outlet orifice on each of the two axially opposite sides of the compressor. This arrangement enables a connection to be made in one or the other axial directions. By providing an inlet and outlet orifice on the periphery of the impeller housing as well, a further degree of freedom is achieved with respect to the direction for connecting the pipelines.

Multi-stage compressors can be formed with the present invention by arranging individual housings side by side.

If the connecting units extend axially at least into the parting plane of the impeller housing, then it is possible to have a direct connection of the corresponding inlet or outlet orifices of the individual compressors, since the orifices fit directly on one another in the axial direction and, consequently, no pipe parts are required as intermediate connections.

It is also advantageous for the connecting units to be combined into a single connecting block. This results in a greater mechanical strength of the compressor.

At least one sealing surface that is adapted in its shape and size to the shape and size of the inlet or outlet orifice is arranged on the impeller housing at an angular distance from the inlet or outlet orifice that corresponds to the angular distance existing between the inlet and the outlet orifices. This allows, in the case of a plurality of compressors arranged on a common drive shaft, for angular displacement of the individual impeller housings relative to each other by an angle corresponding to the angular distance, resulting in the inlet and outlet orifice facing the impeller housing of the adjacent compressor being sealed by the sealing surface of the other impeller housing. Thus, separate sealing of the orifices is not needed, as the impeller housing sealing surfaces accomplish sealing. It is also possible to bring the inlet orifice of one compressor into engagement with the outlet orifice of the other compressor and, thus, to connect the two compressors in series. The outlet orifice of one compressor and the inlet orifice of the other compressor are thereby sealed by the corresponding sealing surface of the other impeller housing, without special measures or attachments being required for this purpose.

If several sealing surfaces are uniformly distributed at an appropriate angular distance over the periphery of the impeller housing, it is then possible to have a series connection of more than two compressors, or the impeller housings of the individual compressors can be angularly displaced relative to one another by a multiple of one angular distance. Thus, in the case of a connection of the pipelines to the side of the connecting units situated in the circumferential direction of the impeller housing, the impeller housing can be turned into a position corresponding to the direction of the pipelines to be connected.

Due to the fact that the inlet and the outlet orifices of the connecting block are surrounded by a seat-engaging surface, it is possible to easily attach any component, such as pipelines, filters, silencers, valves or covers.

BRIEF DESCRIPTION OF THE DRAWINGS

The invention may be understood on the basis of exemplary embodiments depicted in simplified versions in the drawings.

DETAILED DESCRIPTION OF THE DRAWINGS

Figure 1:
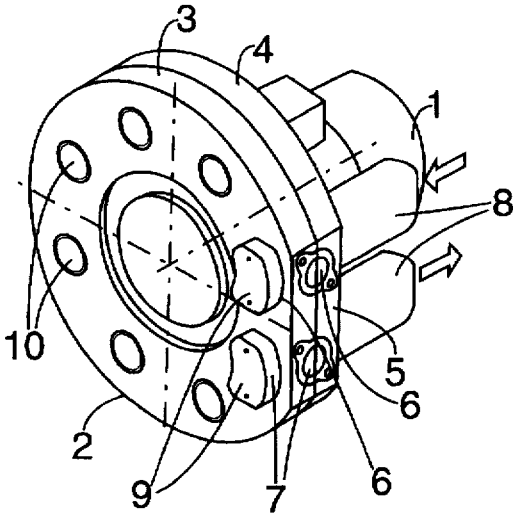
FIG. 1 shows a side channel compressor having pipe connectors pointing in the same direction.
Figure 2:
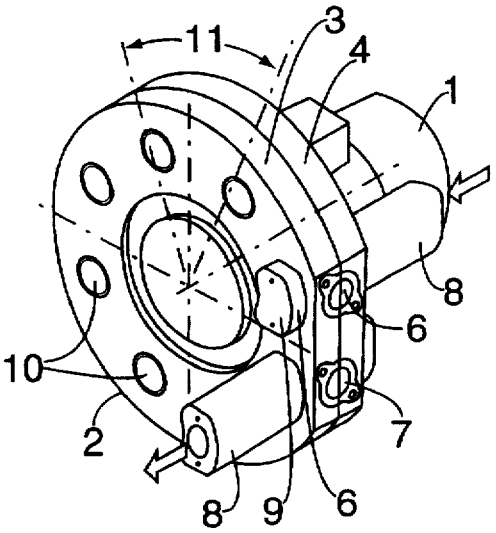
FIG. 2 shows a side channel compressor having pipe connectors pointing in opposite directions.

In FIGS. 1–7, reference numeral 1 denotes a drive motor that is flange-mounted on the impeller housing of a side channel compressor 2. In the exemplary embodiments according to FIGS. 1 and 2, only one side channel compressor 2 is coupled to the drive motor 1. The side channel compressor 2 includes two housing halves or connecting units 3 and 4. Connecting block 5, composed of the connecting units 3 and 4, is provided on the impeller housing. Inlet and outlet orifices 6 and 7 can be situated in different directions on the side channel, for example on both axial end faces and on the circumferential peripheral side. Attached to each of these orifices 6 and 7 is a tubular piece 8, which is designed, for example, as a silencer. Appropriate pipelines can then be joined to the tubular pieces 8.

More degrees of freedom are created for connecting the pipelines by the use of inlet and outlet orifices 6 and 7 situated in different directions on the housing halves 3 and 4. Depending on the direction for laying the pipelines, which is determined by construction conditions at the side channel compressor installation site, the most favorably situated inlet or outlet orifice 6 or 7 can be selected for connecting the pipeline. The orifices 6 and 7 that are not required are each sealed by a cover 9.

Uniformly distributed sealing surfaces 10 are premolded on the end faces of the housing halves 3 and 4, over their entire axial periphery. The angular distances 11 between these sealing surfaces 10 correspond both among themselves as well as with respect to the inlet or outlet orifice 6 or 7 to the angular distance between the two orifices 6 and 7. Furthermore, in their shape and size, the sealing surfaces 10 correspond to the shape and size of the inlet and outlet orifices 6 and 7.

Figure 3:
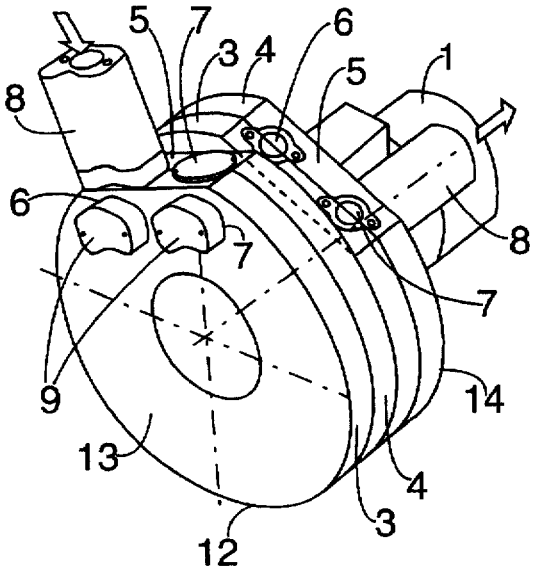
FIG. 3 shows two side channel compressors coupled to one another and connected in series, one having a radially and one an axially directed pipe connector.
Figure 4:
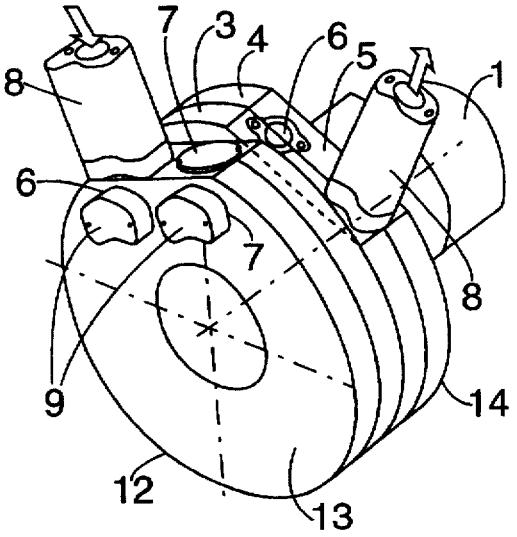
FIG. 4 shows two side channel compressors coupled to one another and connected in series having two radially directed pipe connectors.

FIGS. 3 and 4 each show two side channel compressors 12 and 14 which are connected in series, in terms of fluid flow. As indicated by an arrow, the fluid to be compressed is supplied via a tubular piece 8 to the inlet orifice 6 of the first side channel compressor 12 situated on the circumferential periphery of the impeller housing. The other inlet orifice 6 situated on the outer front end 13 of the impeller housing is sealed by a cover 9. The impeller housing of the second side channel compressor 14 is angularly displaced relative to the impeller housing of the first side channel compressor 12 by an angle corresponding to the angular distance between the inlet and outlet orifice 6 and 7. In this way, the inlet orifice 6 of this second side channel compressor 14 situated on the corresponding front end comes into engagement with the outlet orifice 7 situated on the inner front end of the impeller housing of the first side channel compressor 12. The inlet orifice 6 situated on the inner front end of the first side channel compressor 12 is sealed by a corresponding sealing surface 10 of the impeller housing of the second side channel compressor 14, and the outlet orifice situated on the end face of the second side channel compressor 14 facing the first side channel compressor 12 is sealed by a corresponding sealing surface 10 of the impeller housing of the first side channel compressor 12. Thus, the flow connections required for the series connection are possible merely by joining the two compressor housings in the appropriate angular orientation. The other inlet and outlet orifices 6 and 7 that are not needed are sealed by means of appropriate covers 9.

The direct coupling of the corresponding inlet and outlet orifices 6 and 7 of the two impeller housings to one another is rendered possible because the connecting block 5 of each impeller housing extends axially at least into the two parting planes of the impeller housing. As a result, the connecting blocks 5 of two impeller housings come directly into contact, so that the orifices 6 and 7 can be directly connected, with the interposition of a sealing element. The sealing surfaces 10 provided on the impeller housing likewise extend right into the side plane of the impeller housing, so that they align with the contact surfaces of the connecting blocks 5 situated on the front end of the impeller housing and, thus, when two impeller housings are joined, are likewise capable of directly sealing off the corresponding orifices 6 or 7.

The representations in FIGS. 3 and 4 are distinguished from one another merely by a different connecting position of the tubular pieces 8 joined to the outlet orifice 7 of the second side channel compressor 14. Of course, the tubular piece 8 joined to the inlet orifice 6 can also be attached to the inlet orifice 6 of the first side channel compressor 12 situated in the axial direction.

Figure 5:
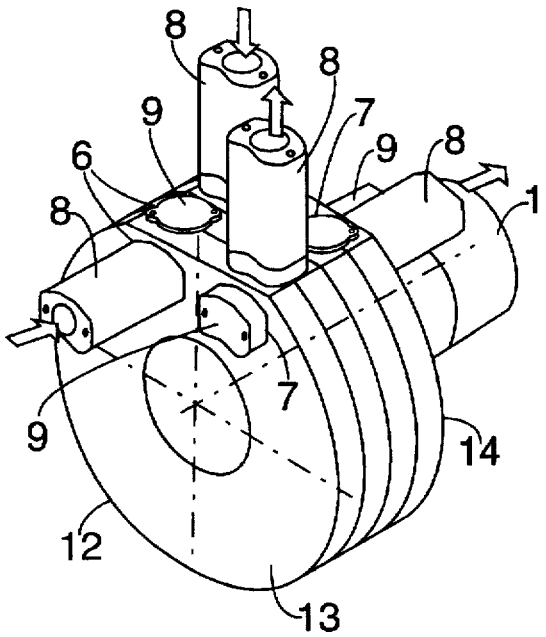
FIG. 5 shows two side channel compressors coupled mechanically to one another which are uncoupled in terms of flow, each having a radially and an axially directed pipe connector.
Figure 6:
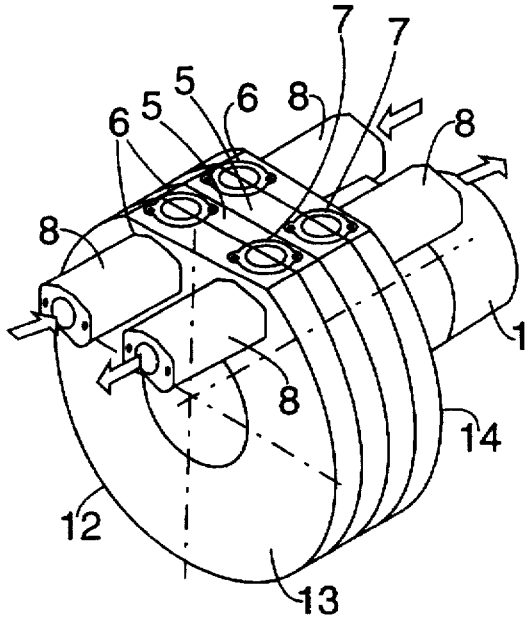
FIG. 6 shows two side channel compressors coupled mechanically to one another which are uncoupled in terms of flow, having axially directed pipe connectors.
Figure 7:
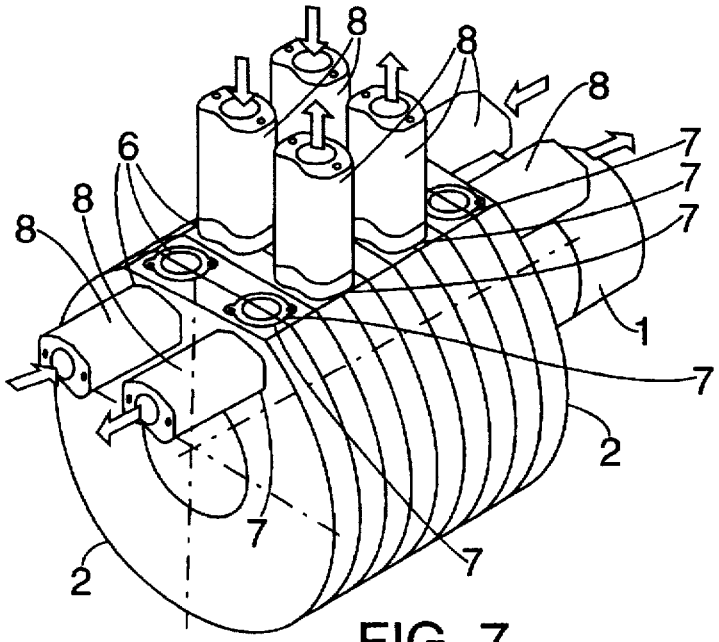
FIG. 7 shows four side channel compressors coupled mechanically to one another which are uncoupled in terms of flow, having axially and radially directed pipe connectors.

FIGS. 5 through 7 show connection alternatives for operation of a plurality of side channel compressor 12 and 14 where flow in a compressor 12 is not coupled to the other compressors 14. The corresponding inlet and outlet orifices 6 and 7 of the individual side channel compressors 12 and 14, are covered depending on the required connecting direction of the pipelines to be connected to the side channel compressor 12 or 14.

Of course, other connection alternatives are possible. Thus, more than two side channel compressors 2 can also be connected in series. The next side channel compressor 2, after being angularly displaced by the appropriate angle opposite the preceding side channel compressor 2, is attached to the preceding side channel compressor 2.

In the case of an aggregate composed of more than two compressors, both series connection of certain compressors can be provided, as well as independent or parallel operation of the remaining compressors. In particular, the inlet and outlet orifices 6 and 7 provided on the periphery of the impeller housing render possible operation of the individual compressors that is independent in terms of flow in the case of aggregates comprised of more than two side channel compressors. This is due to the fact that the inlet and outlet orifices are accessible independently of one another.

I claim:

1. A compressor comprising:

an impeller housing, said impeller housing comprising at least two connecting units, each said connecting unit comprising at least one inlet orifice and at least one outlet orifice, said at least one inlet orifice and said at least one outlet orifice being located on an axial face of said connecting units.

2. The compressor according to claim 1, wherein:

the connecting units extend axially to a parting plane of said impeller housing.

3. The compressor according to claim 1, wherein:

said connecting units are combined into a connecting block.

4. The compressor according to claim 1, further comprising:

at least one sealing surface that is adapted in its shape and size to a shape and size of said at least one inlet and outlet orifices, said at least one sealing surface being arranged on said impeller housing at an angular distance from at least one of said inlet orifice and said outlet orifice, which angular distance is substantially equal to an angular distance between said inlet orifice and said outlet orifice.

5. The compressor according to claim 4, further comprising:

a plurality of said sealing surfaces uniformly distributed over an axial periphery of said impeller housing.

6. The compressor according to claim 1, wherein:

said inlet and the outlet orifices are surrounded by a bearing surface, to which a component can be attached.

* * * * *